US005836853A

United States Patent [19]

Marciano

[11] Patent Number: 5,836,853

[45] Date of Patent: Nov. 17, 1998

[54] SYSTEM FOR THE DETECTION AND SIGNALLING OF HITS IN THE SPORT OF FENCING

[75] Inventor: Frederic Marciano, Strasbourg, France

[73] Assignee: Computer Masters International, Besancon, France

[21] Appl. No.: 731,306

[22] Filed: Oct. 15, 1996

[30] Foreign Application Priority Data

Oct. 12, 1995 [FR] France ..... 95 12189

[51] Int. Cl.[6] ..... A63B 69/02

[52] U.S. Cl. ..... 482/12; 482/83; 482/84; 482/90

[58] Field of Search ..... 482/12, 83, 84, 482/90; 463/1, 4, 5, 7, 8

[56] References Cited

U.S. PATENT DOCUMENTS

| | | | |
|---|---|---|---|
| 3,529,822 | 9/1970 | Rubin | 273/1 |
| 4,030,731 | 6/1977 | Delcayre | 482/12 |
| 4,702,475 | 10/1987 | Elstein et al. | 482/84 |
| 4,761,005 | 8/1988 | French et al. | 482/84 |

*Primary Examiner*—Glenn E. Richman
*Attorney, Agent, or Firm*—Young & Thompson

[57] ABSTRACT

A system for the detection and signalling of his in fencing is characterized in that its main components are portable hit detection units (1) each carried by a fencer and electrically connected to the corresponding weapon (2), at least one central (3) hit discrimination and signalling unit electrically connected to the conductive strip (4) and shoes with conductive soles (5) carried by each fencer and allowing an electrical connection between the conductive strip (4) and the hit detection units (1) and eventually the conductive valid hit surfaces worn by each fencer (6) (foil and saber).

16 Claims, 3 Drawing Sheets

SYSTEM FOR THE DETECTION AND SIGNALLING OF HITS IN THE SPORT OF FENCING

FIELD OF THE INVENTION

Background of the Invention

The following invention is devoted to the sport of fencing and with the introduction of a new system for hit detection and signalling.

Fencing is made up of three different weapons: the epee, the foil and the saber. Each weapon has its own regulations and requires specific equipment and accessories.

Before the advent of electrical hit detection, the referee was the sole person responsible with the attribution of hits. Detecting hits, "on the fly", was a constant source of dispute and conflict considering the extreme rapidity of these hits. It was thus deemed necessary to replace human judgment by a reliable and impartial electrical hit detection system.

As shown in FIGS. 1 and 2 of the accompanying drawings which depict a current system, in a sketchy way, the fencers are connected to the central detection and signalling unit through a 3 wire cable. The fencer's weapon is connected to this cable through a body cable and the permanent tension of the cable is accomplished through the use of a spool placed at the end of the strip.

The central scoring unit, placed on the side of the strip, monitors the state of a bout continually by sending electric current signals. When the unit has decided that one of the fencers has been hit, a colored lamp (red or green) is used to signal a valid hit while a white lamp signals the so called invalid hit (foil).

A bout always takes place on a metallic strip made up of a metallic fabric or aluminum plates. This strip, connected to the central scoring unit, is used to cancel hits to the ground in the epee and foil.

This system, described in broads terms, must be adapted to the specifics of each weapon.

Hence, for the epee, a fencer may hit opponent anywhere (from the head down to the foot) and the rules for this weapon are particularly simple since the first to hit scores a point. Detection is accomplished through the use of a springy sword tip akin to a snap switch.

In the case of the foil, a valid hit is necessarily borne on the opponent's plastron. To detect this hit, each fencer must carry a metallic plastron in order to mark this surface electrically. If a fencer hits his opponent on any other part of the body, a non valid hit is signalled. Futhermore, a set of rules and conventions is applied to a signalled hit in order to declare a change in score. Like the epee, the foil also uses a snap switch type point.

Finally, the saber is a weapon of cut and thrust which means that the fencer may hit his opponent equally with the point or the edge of the blade. The valid surface consists of the top part of the body (including the arms and the head), this surface being distinguished by a metallic vest and a conductive mask.

Currently, in all three of these weapons, the fencers are connected to spools themselves connected to the central detection and scoring unit.

The suppression of these connection cables would make the current "rigging" of the fencers obsolete and restore their freedom of movement. It would thus become possible to run bouts on a circular or rectangular strip and no longer be limited to the current linear strip.

In order to free fencers of this point to point cable connection, the introduction of a portable detection device on each fencer with radio communications to the central unit has been suggested.

However, the actual implementation of these systems has not proven very reliable in terms of hit detection.

The problem lies in the absence of any common ground or reference making hit detection very difficult if not altogether impossible.

In effect, the portable hit detection and transmission devices on each fencer are decoupled since they have no common reference making current analysis impossible.

Other devices have subsequently been implemented to try and circumvent this difficulty by changing the tip of the blade in the epee so that the point may detect the contact with a metallic surface (by short circuit for example).

Other devices yet resort to the use of low frequency waves in the vest, guard etc., that are then detected during contact with the weapon. However, all these devices have several major flaws in that they are notoriously less reliable than the current wire system, do not implement detection systems in all three weapons, and/or require modification of current equipment.

Furthermore, beyond the drawbacks described previously, all these systems using radio waves for transmission of hit detection are prey to jamming and outside interference and require additional sophisticated technology in order to have more than one bout take place at the same time (multiple channels or frequency hopping) and be able to adapt to different locations with different regulations with respect to authorized frequencies.

SUMMARY OF THE INVENTION

The goal of the present invention is to provide a system that is not afflicted by the drawbacks described above with a simple reliable device that may be used in all three weapons without any modification of equipment and existing accessories while allowing for a centralized processing and display of results and enabling fencers to accomplish circular movements and not just linear ones.

To is effect, the present innovation is designed as a system of hit detection and signalling for at least two fencers moving on a conductive strip consisting of the following elements: on one hand portable hit detection units electrically connected to the fencer's weapon, on the other hand a central processing and signalling unit electrically connected to the conductive strip, and finally shoes with electrically conductive soles on each fencer allowing an electrical connection between the conductive strip and the detection units and eventually the conductive plastrons or vests worn by the fencers (for the foil and saber).

BRIEF DESCRIPTION OF THE DRAWINGS

The invention will be best understood with the description given below that represents a preferred implementation given as a non restrictive example and commented with reference to the figures provided in the appendix where.

DETAILED DESCRIPTION OF THE INVENTION

Figure 1:
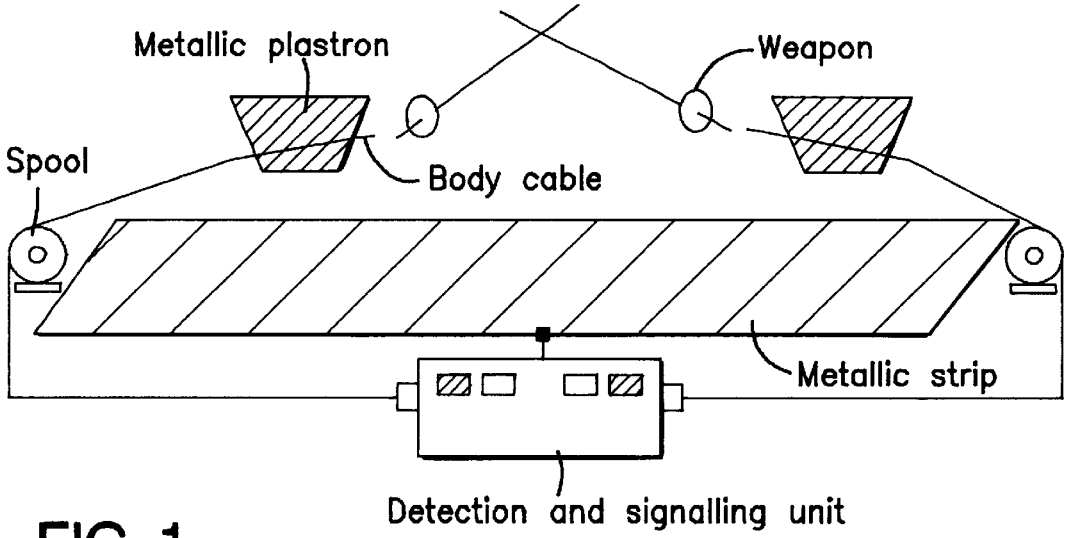
FIGS. 1 and 2 are schematic views of a known hit detection and signalling system.
Figure 2:
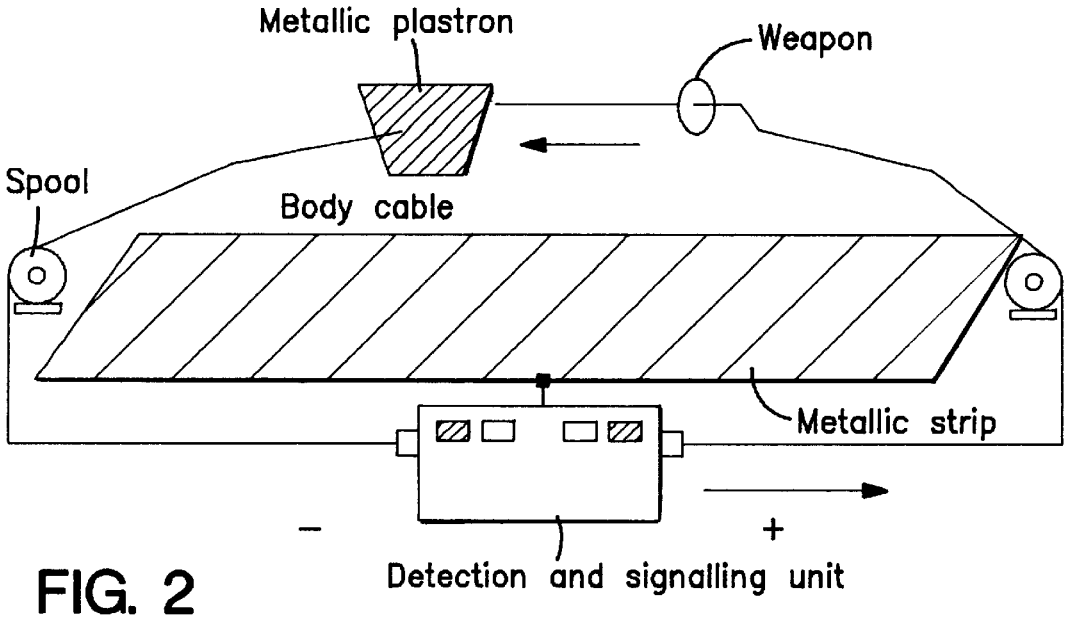
Figure 3:
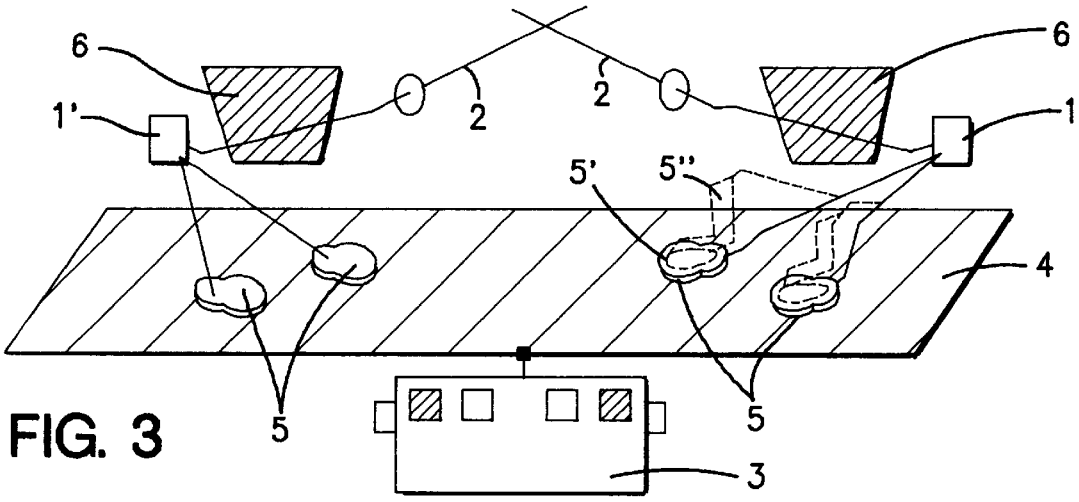
FIG. 3 is a schematic view of the invention applied to the foil.
Figure 4A:
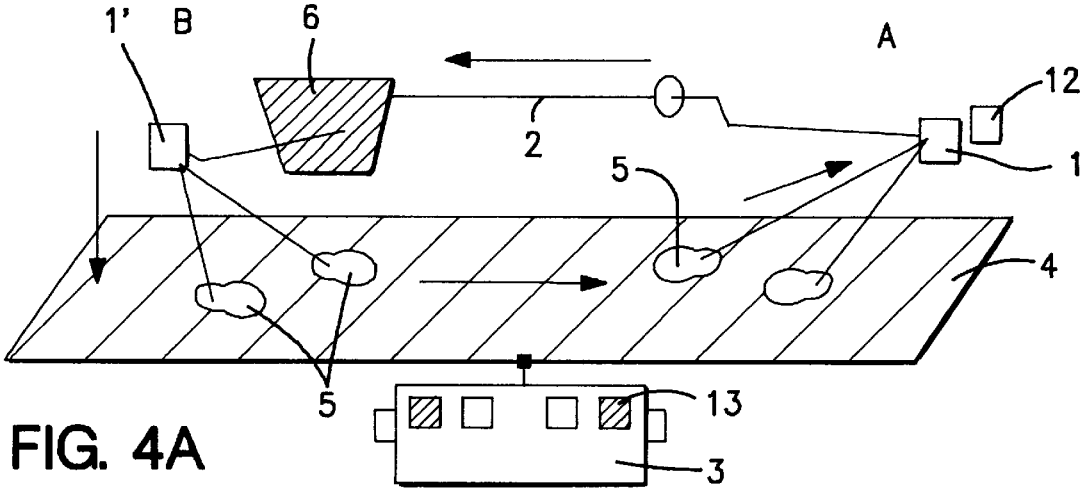
FIG. 4A is a schematic view identical to FIG. 3 that describes the electrical signals involved in the process of hit detection.
Figure 4B:
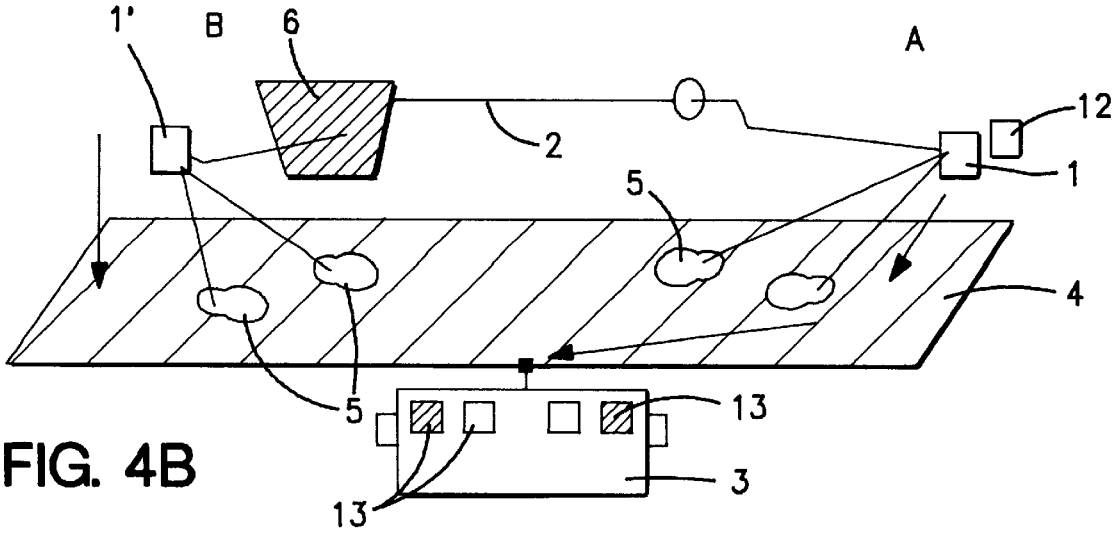
FIG. 4B is a schematic view identical to FIG. 4A that shows how signals are transmitted to the central unit after a hit has been detected.

As shown in FIGS. 3 and 4 and in compliance with the invention, the hit detection and signalling system is comprised, on one hand of the detection units 1 and 1' each carried by one of the fencers and electrically connected to the corresponding weapon 2, and on the other hand at least one central scoring and signalling unit electrically connected to the conductive strip 4 and finally of conductive soles 5 worn by each of the fencers in order to provide an electrical connection between the conductive strip 4 and the detection units 1 and 1' and eventually of the conductive valid hit surfaces 6 worn by each fencer (in the foil and saber).

Figure 5:
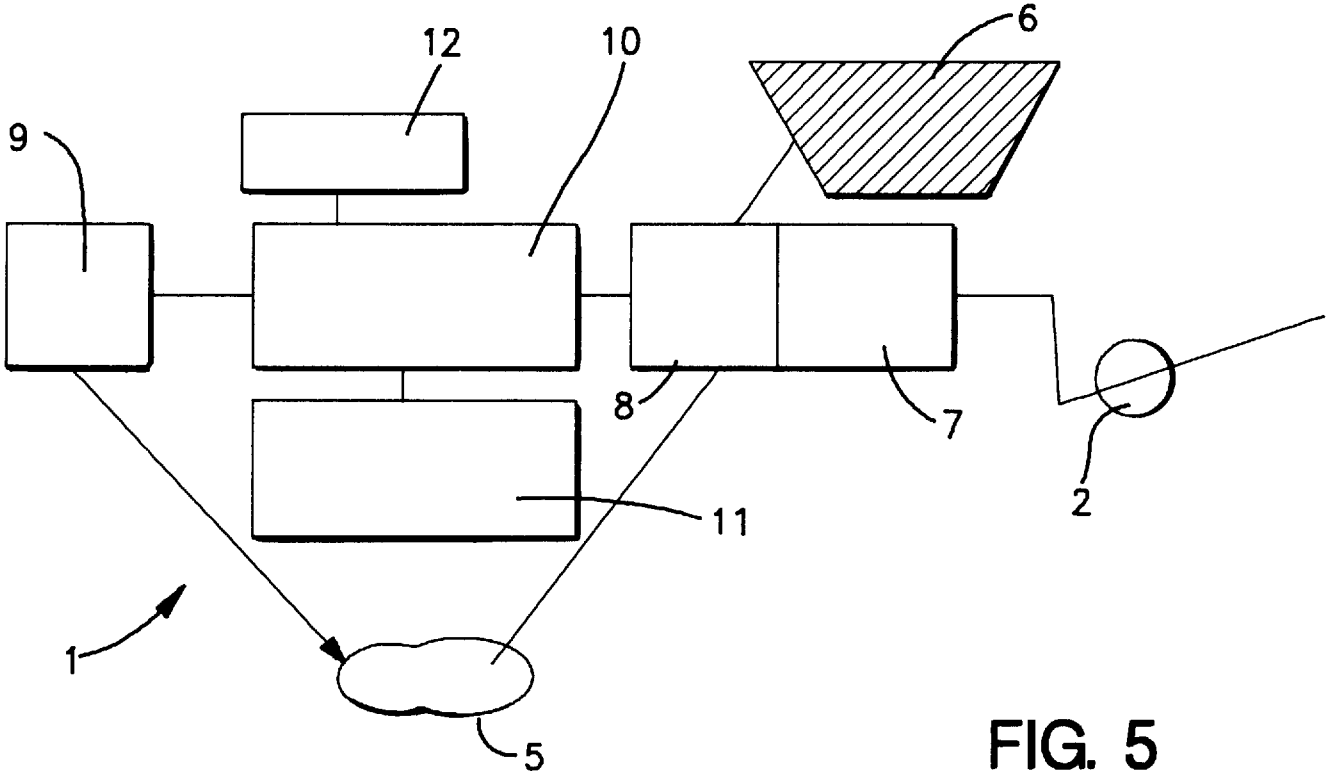
FIG. 5 is a block view of the portable detection unit shown in FIG. 3.

According to a first characteristic of the innovation, represented in FIG. 5 of the drawings, each detection unit 1, 1' is comprised on one hand, of a transmitter 7 of electrical detection signals, connected to the weapon 6, and a detector 8 tuned to receive these signals and connected to the weapon 2 or to the conductive soles 5 and, on the other hand, a transmitter 9 of signalling signals distinct from the detection signals in each detection unit 1, 1' connected to the conductive soles 5 and finally a logic processing module 10 referenced to an oscillator 11. All these elements from 7 to 11 are placed in a portable case on each fencer and powered independently by a battery 12 or an accumulator.

In a preferred embodiment, transmitter 7 and receiver 8 may consist respectively of a current generator and current detector and transmitter 9 may transmit information related to the detection of a hit through low frequency electrical signals, comprised, for example, between 50 kHz and 150 kHz and preferably of about 100 kHz.

The hit discrimination and signalling unit 3 is essentially comprised of a receiver tuned to the signalling signals from the portable units 1, 1' that are transmitted through the conductive strip 4, a central processing unit and at least a visual and sound display 13 unit.

As a better implementation, the central unit 3 for hit discrimination and signalling may consist of a scoring unit known as Fencing Technologies models SG11, SG21 or SG31 produced by COMPUTER MASTERS INTERNATIONAL, in which a new low frequency detector has been added.

Similarly, the detection units 1, 1' may consist of the same detector powered by an independent power supply and a low frequency transmitter designed with a transmission frequency or a particular coded signal specific to each unit 1, 1'.

As we have seen, the detection and signalling of a hit are implemented with principles similar to those used in the current scoring units mentioned above.

Although each fencer may be equipped with a detection unit 1, 1' autonomous and independent, as far as the power supply is considered, the possibility of connecting each unit to the metallic strip through the conductive soles 5 leads to a complete integrated system with a common ground or reference.

Consequently, the conductive soles 5 are used in all three weapons as electrical interfaces for transmission signals with the following transmission path: detection unit 1, 1'—body cable on the fencer—conductive soles 5—conductive strip—central hit discrimination and signalling unit 3 (see FIG. 4.B)

However, in the case of the foil and saber, they are also used as shown in FIG. 4A to implement a closed electrical circuit in case of a valid hit on the conductive surface born by the fencer (metallic plastron or metallic vest and conductive mask) and are used as electrical interfaces between the fencer and the metallic strip in the following path: transmitter 7 of the detection unit 1 on fencer A—body cable—weapon 2 of fencer A—conductive surface 6 of opponent B (plastron)—body wire—conductive soles of fencer B—conductive strip 4—conductive soles 5 of fencer A—receiver 8 of detection unit 1 of fencer A.

In the case of the epee, the conductive soles 5 are also used as electrical interfaces between the conductive strip and the fencers but only for hits that result of a contact of the point of the weapon with the conductive strip 4 and the opponent's guard.

In all the implementations of the invention, the transmission mode consisting of a sliding electrical contact: conductive soles 5/metallic strip accomplishes a twofold mission, which is on one hand to implement a permanent element of the closed detection circuits and their associated signals and on the other hand to provide a permanent electrical circuit for the transmission of low frequency signals announcing a detected hit, specific to each detection unit 1, 1' from these units to the central hit discrimination and signalling unit 3 (discrimination in time between hits, display), electrically connected to the conductive strip 4.

It is noteworthy that the electronic components in detection units 1, 1' and the central hit discrimination and signalling unit 3 are numeric and that the parameters for detection units 1, 1' may be sent through a series connection of the RS422 type.

According to one possible implementation, the conductive soles 5 are made up of a flexible polymer material or rubber carrying within its body and level with the side in contact with the strip, a metallic insert in the form of cloth, wire mesh, grid or a similar device made up of metallic wires, fibers or filaments connected through a flexible cable to the corresponding detection unit.

According to a second possible implementation of the invention, represented with a dashed line on one of the fencers of FIG. 3 in the appendix, the conductive soles 5 are made of a flexible polymer material of rubber type designed for transmission of low frequency waves, in particular of low frequency current signals with the integration, in its body, of carbon particles, a metallic insert in the form of a braided conductor wire or a flexible grid 5', inside the body of the polymer and linked to a connector enabling an electrical connection between the soles 5 and the corresponding detection unit 1, 1' (this connection is implemented through a flexible connection cable).

The insert made up of fibers or metallic wires should be flexible enough in order not to perturb significantly the flexibility and absorption of shock and vibrations of the polymer or rubber soles.

According to a third implementation of the invention, the conductive sole 5 is made up of a flexible essentially non conductive material with the interior side at least covered with a flexible strip or film of conductive material or metallic inserts linked with a flexible cable connector to the corresponding detection unit 1.

In order to provide a non floating ground or reference point to the generator of low frequency signals of each detection unit 1, 1' so as to achieve an efficient and reliable transmission through the conductive strip 4, it can be interesting to provide each fencer with socks made up of a conductive material 5" in contact with the body of the fencer and electrically isolated from the corresponding conductive soles that are connected to the detection unit 1, 1' with a connector on the socks 5" and a connection cable.

Thanks to this device it is possible to have only one connector on each shoe, each connector having two pins, one in contact with the conductive sole 5 and hence to the conductive strip 4 and one in contact with the body through the conductive sock 5".

Of course, the invention is not limited to just the implementation described and presented in the drawings. Modifications are possible with regard to the actual implementation of the different elements without departing from the scope of protection of the present invention.

I claim:

1. A system for the detection and signalling of hits in a fencing bout between two fencers carrying conductive surfaces and a weapon, and moving on a conductive strip, the system comprising:

two portable hit detection units, each detection unit adapted to be carried by each fencer, and being electrically connected to a corresponding weapon;

each detection unit including a first transmitter of electrical detection signals, connected to a corresponding weapon, and a second transmitter for transmitting hit signalling signals when a hit is detected, said signalling signals being distinct from the detection signals and characteristic of each detection unit;

a single central unit for hit discrimination and signalling, said central unit being electrically connected to the conductive strip, and including means for receiving signals transmitted by the hit detection units and transmitted through the conductive strip; and shoes with conductive soles adapted to be worn by each fencer for making an electrical connection between the conductive strip and the hit detection units, and the conductive surfaces of each fencers.

2. The system according to claim 8, wherein each detection unit further includes the following components:

a receiver tuned for the detection of said detection signals and connected to at least one of the corresponding weapon and the conductive soles; and a logic processing module having a corresponding reference isolator;

said components being packaged in a portable case adapted to be carried by each fencer and being powered independently by a battery or accumulator.

3. The system according to claim 1, wherein the central hit discrimination and signalling unit further includes a logic processing module and a means for visual and auditive signalling of hits.

4. The system according to claim 1, wherein the conductive soles are made of a flexible polymer or a rubber material carrying within its body, and level with the side in contact with the strip, a metallic insert connected through a flexible cable to the corresponding hit detection unit.

5. The system according to claim 4, wherein the metallic insert is in the form of one of cloth, wire mesh, and grid, and is made of one of wires, fibers and metallic filaments.

6. The system according to claim 1, wherein the conductive soles are made of a flexible polymer or rubber material designed for transmission of low frequency signals, and integrating within its body carbon particles, the system further comprising a braided conductive cable linked to an outside connector for providing an electrical connection between the soles and the corresponding hit detection unit.

7. The system according to claim 1, wherein the conductive soles are made of a flexible nonconductive material having at least one internal side covered with a metallic strip or film of conductive material linked through a flexible conductive cable to the corresponding hit detection unit.

8. The system according to claim 1, wherein each fencer is equipped with socks made of a conductive cloth in contact with the fencer's body and electrically isolated from the corresponding conductive soles which are connected to a corresponding hit detection unit through a conductor linked through the socks and a connection cable.

9. A system for the detection and signalling of hits in a fencing bout between two fencers carrying conductive surfaces and a weapon, and moving on a conductive strip, the system comprising:

two portable hit detection units, each detection unit adapted to be carried by each fencer, and being electrically connected to a corresponding weapon;

a single central unit for hit discrimination and signalling, said central unit being electrically connected to the conductive strip, and including means for receiving signals transmitted by the hit detection units and transmitted through the conductive strip; and shoes with conductive soles adapted to be worn by each fencer for making an electrical connection between the conductive strip and the hit detection units, and the conductive surfaces of each fencers, said conductive soles being made of a flexible polymer or rubber material designed for transmission of low frequency signals, and integrating within its body carbon particles, the system further comprising a braided conductive cable linked to an outside connector for providing an electrical connection between the soles and the corresponding hit detection unit.

10. The system according to claim 9, wherein each detection unit includes the following components:

a first transmitter of electrical detection signals, connected to the corresponding weapon;

a receiver tuned for the detection of said detection signals and connected to at least one of the corresponding weapon and the conductive soles;

a second transmitter for signalling signals distinct from the detection signals and characteristic of each detection unit, connected to the conductive soles; and a logic processing module having a corresponding reference isolator;

said components being packaged in a portable case adapted to be carried by each fencer and being powered independently by a battery or accumulator.

11. The system according to claim 9, wherein the central hit discrimination and signalling unit further includes a logic processing module and a means for visual and auditive signalling of hits.

12. The system according to claim 9, wherein each fencer is equipped with socks made of a conductive cloth in contact with the fencer's body and electrically isolated from the corresponding conductive soles which are connected to a corresponding hit detection unit through a conductor linked through the socks and a connection cable.

13. A system for the detection and signalling of hits in a fencing bout between two fencers carrying conductive surfaces and a weapon, and moving on a conductive strip, the system comprising:

two portable hit detection units, each detection unit adapted to be carried by each fencer, and being electrically connected to a corresponding weapon;

a single central unit for hit discrimination and signalling, said central unit being electrically connected to the conductive strip, and including means for receiving signals transmitted by the hit detection units and transmitted through the conductive strip; and shoes with conductive soles adapted to be worn by each fencer for making an electrical connection between the conductive strip and the hit detection units, and the conductive surfaces of each fencers, said conductive soles being made of a flexible non-conductive material having at least one internal side covered with a metallic strip or film of conductive material linked through a flexible conductive cable to the corresponding hit detection unit.

14. The system according to claim 13, wherein each detection unit includes the following components:

a first transmitter of electrical detection signals, connected to the corresponding weapon;

a receiver tuned for the detection of said detection signals and connected to at least one of the corresponding weapon and the conductive soles;

a second transmitter for signalling signals distinct from the detection signals and characteristic of each detection unit, connected to the conductive soles; and a logic processing module having a corresponding reference isolator;

said components being packaged in a portable case adapted to be carried by each fencer and being powered independently by a battery or accumulator.

15. The system according to claim 13, wherein the central hit discrimination and signalling unit further includes a logic processing module and a means for visual and auditive signalling of hits.

16. The system according to claim 13, wherein each fencer is equipped with socks made of a conductive cloth in contact with the fencer's body and electrically isolated from the corresponding conductive soles which are connected to a corresponding hit detection unit through a conductor linked through the socks and a connection cable.

* * * * *